United States Patent [19]

Matthews

[11] 4,272,069

[45] Jun. 9, 1981

[54] METHOD OF AND APPARATUS FOR SLOWING SHEETS CARRIED BY HIGH-SPEED CONVEYORS BEFORE DEPOSIT ON STATIONARY PLATFORMS OR LOW-SPEED CONVEYORS

[75] Inventor: Merton L. Matthews, Westerly, R.I.

[73] Assignee: Maxson Automatic Machinery Company, Westerly, R.I.

[21] Appl. No.: 1,430

[22] Filed: Jan. 8, 1979

[51] Int. Cl.[3] ..... B65H 29/68

[52] U.S. Cl. ..... 271/182; 271/273

[58] Field of Search ..... 271/182, 202, 203, 229, 271/230, 265, 270, 273, 274

[56] References Cited

U.S. PATENT DOCUMENTS

| | | | |
|---|---|---|---|
| 2,177,460 | 10/1939 | Renz | 271/202 X |
| 3,507,489 | 4/1970 | Wilshin et al. | 271/182 |
| 3,947,021 | 3/1976 | Plate | 271/182 |

*Primary Examiner*—Robert W. Saifer

*Attorney, Agent, or Firm*—Rines and Rines, Shapiro and Shapiro

[57] ABSTRACT

Method and apparatus involving passing the leading edge of successive sheets carried by a high-speed conveyor over a slow-down region, and when the rear edge portion of the sheet reaches said region, grabbing the same to slow down the sheet to the desired speed and then releasing it and permitting the leading edge of the next sheet to travel freely at high speed over said region, thereby to enable controlled slow-down of the high-speed sheets for predetermined overlap on lower speed conveyors or stacking on platforms and the like.

11 Claims, 11 Drawing Figures

METHOD OF AND APPARATUS FOR SLOWING SHEETS CARRIED BY HIGH-SPEED CONVEYORS BEFORE DEPOSIT ON STATIONARY PLATFORMS OR LOW-SPEED CONVEYORS

The present invention relates to sheet conveying and delivery apparatus and methods, being more particularly directed to a novel method of and apparatus for slowing sheets carried by high-speed conveyors before deposit upon low-speed conveyors or stacking platforms and the like.

Previous techniques for attaining overlap of sheets fed from high-speed conveyors to lower-speed conveyors are described, for example, in prior patents of the assignee of the present application, including U.S. Pat. Nos. 2,261,971; 2,698,176; and 3,975,012. While these have worked admirably well for a wide variety of applications and sheets of different types and thicknesses of materials, they have not provided a high degree of control over the precise amount of overlap upon delivery to the lower-speed conveyors, or the precise speed of delivery to stationary platforms or the like, or highly controllable variation of the same, as desired.

It is to the solution of this and related problems, including slowing the sheets without overlap, accordingly, that the present invention is primarily directed, with an object of the invention residing in the provision of a new and improved method of and apparatus for arresting or slowing down the forward motion of sheet material and the like being carried forward by a high speed conveyor in a controlled manner and without overlap at that region, for the purpose of being deposited on a slower moving conveyor. Such deposit or delivery on a slower conveyor can form a slow stream of sheets, then of predetermined overlap, moving in the same direction as the sheets on the high-speed conveyor but being transported forward at a much reduced, predetermined speed.

A further object of the invention is to provide a novel method of and apparatus for arresting or slowing down the forward motion of sheet material being carried forward by a high-speed conveyor in a controlled manner to enable the sheet to be deposited upon a stationary platform upon which successive sheets so deposited may be jogged into a neat pile with the help of suitable side, back and/or front jogger mechanisms, as described in said U.S. Patent.

Other and further objects will be explained hereinafter and are more particularly described in connection with the appended claims.

In summary, however, from one of its broader aspects, the invention embraces a method of slowing the delivery of sheets carried by a high-speed conveyor before deposit upon such an area as low-speed conveyors and stacking platforms, that comprises, feeding successive sheets at relatively high speed over a slow-down region preceding such an area; monitoring the approach of the rear portion of each successive high-speed sheet towards said region and thereupon grabbing such rear portion and decelerating the grabbed sheet to a predetermined slower speed; releasing the grabbed sheet to enable delivery of the same at said predetermined slower speed upon said area; and thereupon feeding the leading portion of the next successive sheet at said high speed over the said region. Preferred constructional details are hereinafter presented including the use of a slow-down roll and cooperative snubber roll disposed between the high-speed conveyor and the low-speed conveyor or platform or other area of delivery of the sheet material, and operable to grab the rear or trailing edge portion of the sheet and decelerate the same. To this end, the invention preferably employs a three-gear, four-bar linkage system used in conjunction with a single-revolution clutch. When properly driven by the high-speed conveyor section and correctly impulsed by a rear or trailing sheet edge monitor sensor, such as a photocell, limit switch, proximity switch or similar unit, this system drives the slow-down roll through one revolution as the trailing edge of the sheet of material leaving the high-speed conveyor passes over it. When driven at a constant input rpm, the system will make one revolution of its output shaft at a variable speed, starting at zero speed, rising to double input speed and slowing to zero speed each time it is pulsed electrically. The outer shaft of this unit is provided with a cam mounted upon it, as later more fully described, which lowers the snubber rolls to press or pinch the paper against the slow-down roll when the surface speed of the roll and the surface speed of the sheet are the same. The rollers raise and release the sheet when it has been slowed to the desired speed. Other preferred details are also hereinafter set forth.

The invention will now be described with reference to the accompanying drawings, FIG. 1 of which is an isometric view of a preferred form of the apparatus of the invention, adapted to operate in accordance with the method underlying the same;

Figure 1:
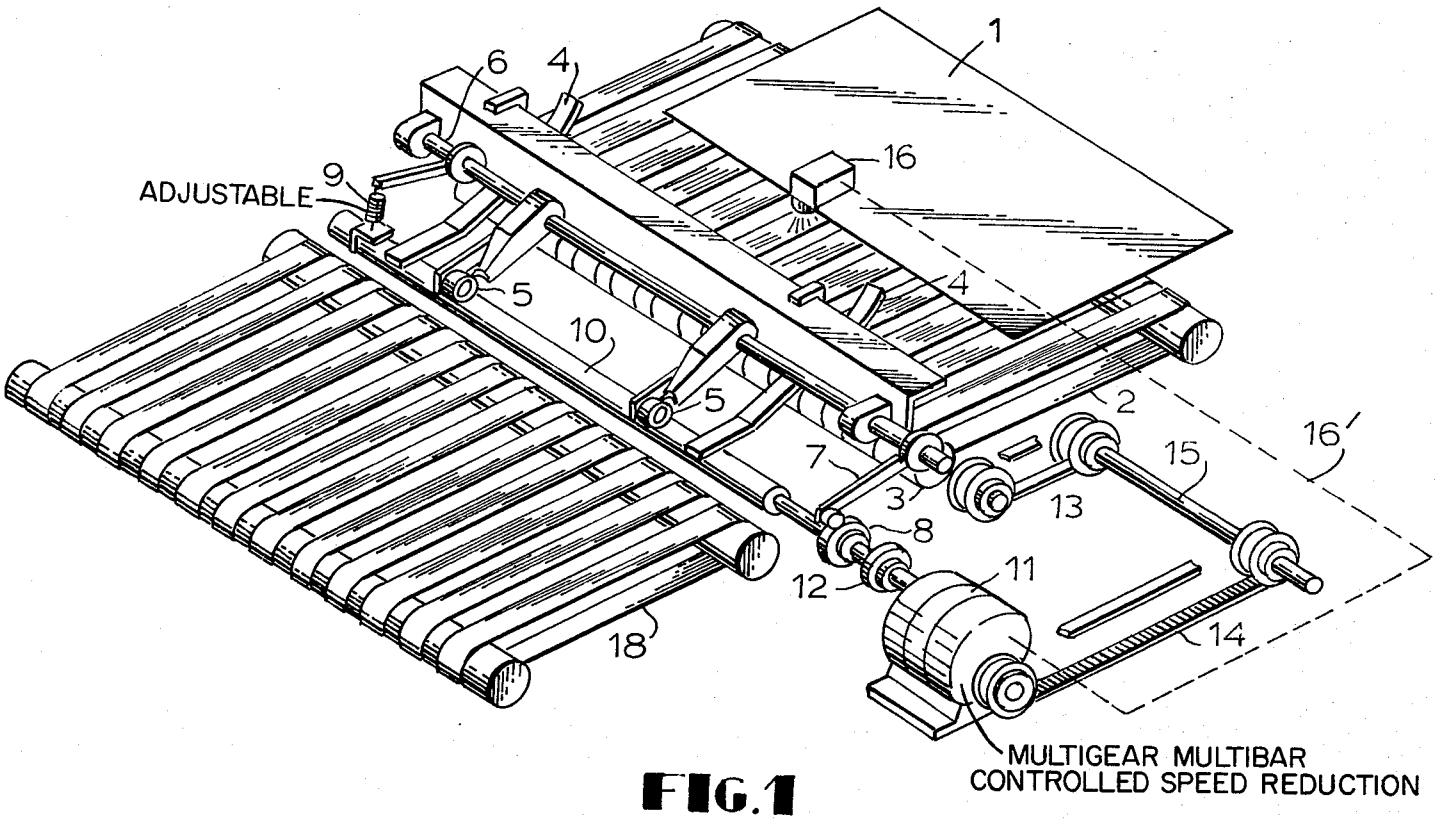
Figure 2:
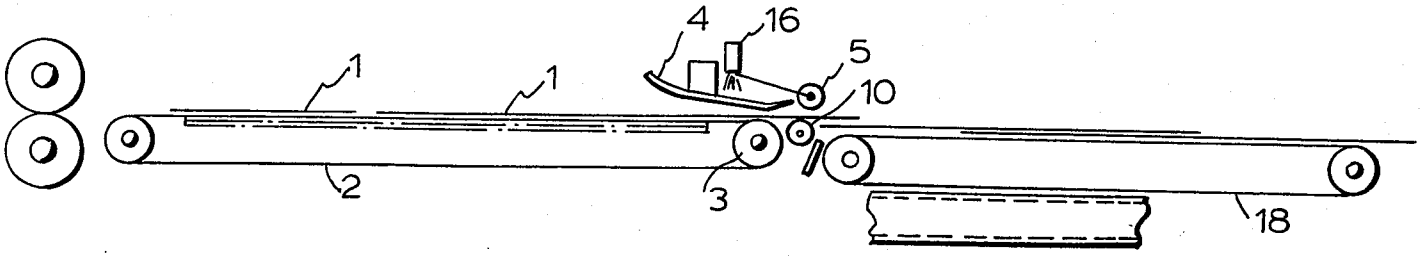
FIG. 2 is a schematic side-elevation of the same.
Figure 3:
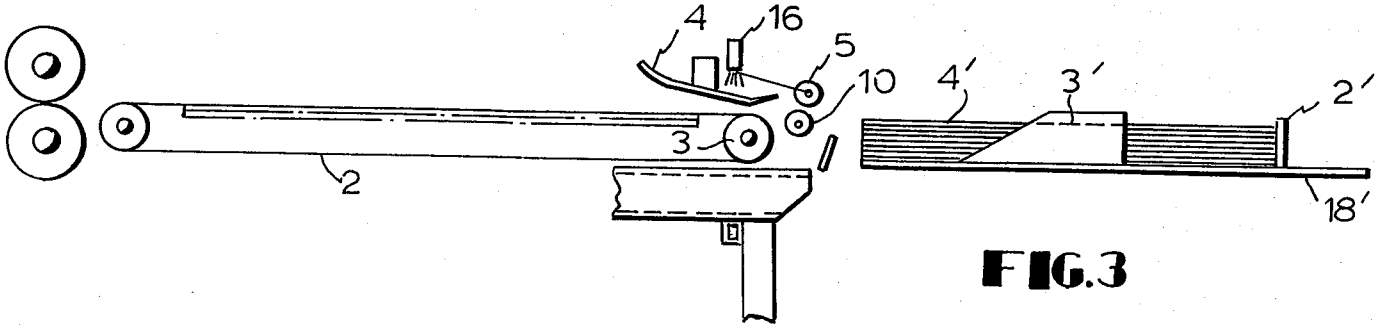
FIG. 3 is a view similar to FIG. 2 with a stacking platform substituted for the low-speed conveyor delivery area of FIGS. 1 and 2.

FIGS. 4, 5, 6 and 7 are similar views illustrating successive instants of time in the operation of the apparatus, shown for illustrative purposes as applied to the platform delivery of FIG. 3, but similarly applicable to the slow-speed conveyor delivery of FIGS. 1 and 2; and FIGS. 8*a*–8*d* constitute a timing diagram of slow-down roll and snubber roll cooperation and operation for effecting the operation of FIGS. 4 through 7.

Referring to FIGS. 1 and 2, the preferred apparatus for arresting or slowing down the successive spaced sheets 1 moving along high-speed conveyors 2 (shown to the right in FIG. 1 and to the left in FIG. 2), is shown delivering the sheets to slow-speed conveyors 18 (to the left in FIG. 1 and to the right in FIG. 2) for forming a highly controllable overlapped stream of sheets. These successive spaced sheets 1 can be held in alignment either by a suction box below the tapes 2 or a set of top tapes (not shown) as described in said U.S. Patent. The sheets feed under a set of guide shoes 4 which prevent the leading edge of the sheet from coming into contact with or otherwise hitting the upper snubber rolls 5 when they are in the raised position shown in FIGS. 1 and 2. The sheets pass over the slow-down region containing bottom slow-down roll 10 which is normally stationary (non-rotating) until the rear, tail or trailing edge portion of a sheet 1 passes under a monitor sensor such as the photocell 16 or some other such suitable sensing unit, at the same speed, or very nearly thereto, as the sheets are moving along the high-speed conveyor section 2.

The sheet 1 being transported at high speed by conveyor section 2 is thus carried forward past the final high-speed conveyor roll 3 under the top confining guide shoes 4 and the before-mentioned snubber rolls 5 which are mounted on a cam-actuated shaft 6 having a follower 7 held in contact with the cam 8 by a tension spring 9. The cam 8 is mounted on the slow-down roll 10, shown for clarity in FIG. 1 as further downstream from the final high-speed conveyor roll 3 than may be the case in actual practice. The slow-down roll 10 is preferably mounted as close as possible to the conveyor roll 3 as more correctly illustrated in FIG. 2.

The slow-down roll 10 is shown connected to the output shaft of, for example, a Hilliard ADU-IDU drive unit 11, or a similar combination single-revolution clutch and three-gear, four-bar linkage unit, by the coupling 12. The input shaft of the unit 11 is driven from the high-speed conveyor by any suitable means of belting or gearing, represented by cog drive belts 13 and 14 driving through a jack shaft 15. The output shaft of the unit, as previously mentioned, starts at zero speed, rises to double input shaft speed, and reduces to zero speed while making one revolution for each single revolution of the input shaft. The drive between slow-down roll 10 and the high speed roll 3 of the conveyors 2 through cog belts 13 and 14 is such that the surface speed of slow-down roll 10, when at maximum speed, is as before stated, substantially equal to the surface speed of high-speed conveyor belts 2. The size or diameter of the slow-down roll 10 may be varied to suit individual applications of the slow-down unit, and the relationship of the diameters of the final high-speed drive roll 3 and the slow-down roll 10 may be varied from application to application; but the relative surface speeds, when the slow-down roll 10 is at its maximum speed, should be equal or approximately equal.

The timing of the speed variation of the slow-down roll 10 is shown in FIG. 8, portion 8*a* of which shows the relationship of the speed (point 17) of the slow-down roll 10, the corresponding position of the slow-down shaft cam 8 and its follower 7 and snubber rollers 5 with respect to slow-down roll 10 for that period of time when the leading edge portion of the sheet 1 approaches the monitor sensor 16 as depicted in FIG. 1, and for that period of time that the sheet is passing under the monitoring sensor 16.

When the rear or trailing edge portion of the sheet 1 passes under the sensor 16, a monitor signal is applied via 16' to pulse the unit 11, and the output shaft starts to make one revolution. Cam 8 starts to rotate and follower 7 causes the snubber shaft 6 to rotate, lowering snubber rollers 5 toward the slow-down roll 10, which is accelerating to equal the speed of conveyor section 2.

Figures 8A, 8B, 8C, 8D:
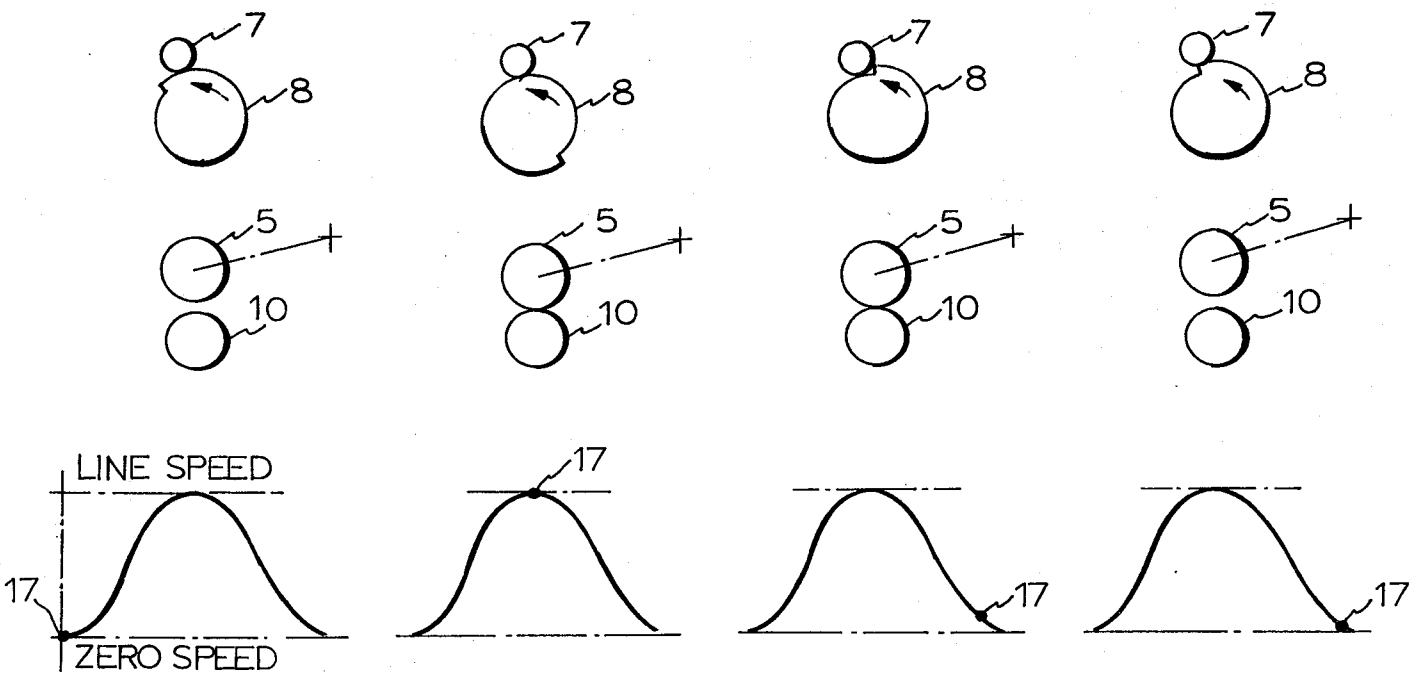

FIG. 8*b* shows the relationship at the moment that the speed of the conveyor 2 and the slow-down roll 10 become equal, as at point 17. The cam follower 7 has then reached the low point of cam 8 and the snubber roll 5 is applied in pressure contact with the slow-down roll 10, grabbing the rear portion of the sheet 1 with friction engagement. The amount of pressure exerted between snubber roll 5 and roll 10 can be varied by adjusting or varying spring 9, shown in FIG. 1.

FIG. 8*c* shows the relationships in the period of time during which the slow-down roll 10 arrests the speed of sheet 1. The cam follower 7 rides along the flat or constant radius section of cam 8 and snubber roll 5 remains in pressure contact with the slow-down roll 10 as the speed of roll 10 decreases, while completing its single revolution. At the point shown, the desired minimum speed has been attained and the follower 7 is about to ride up the high or release point of cam 8.

In FIG. 8 *d*, the relationship of the follower 7, cam 8, and the slow-down roll 10 with snubber roll 5 is illustrated as the slow-down roll makes its final few degrees of rotation and approaches zero speed or the stationary condition again. Pressure has thus been released between the snubber roll 5 and the slow-down roll 10 and the snubber roll has raised to allow the leading edge portion of the next sheet 1 freely to pass under snubber rollers 5, and over the slow-down roll 10 at the slow-down region. The slow-down roll will now dwell at zero speed until the trailing or rear edge portion of the next successive sheet 1 passes under the monitor sensor 16 of FIG. 1 and the cycle is repeated. A current of air directed in the same direction of travel as sheets 1 or through orifices in the hollow slow-down roll 10 (not shown) may be used to float long limp sheets out over the slow-moving conveyor 18, if necessary.

The embodiment of FIG. 3 shows the same general arrangement as FIG. 2, excepting that the slow-moving conveyor tapes 18 are replaced by a board, pallet, or skid 18' which is supported by an elevating mechanism or table of suitable design (not shown), but as described, for example, in said U.S. Patent. The slowed sheets are shown deposited on this pallet and confined by stationary front stops 2' and side guides or blades 3' to form a neat and manageable pile 4. The front stops 2' and side blades 3' may be replaced by moving or vibrating joggers to obtain a more neat and high quality pile, as also described in said U.S. Patent. The pallet 18' may be replaced by an air float table equipped with suitable pushers and ream stacks or lifts may be moved out of the stacking position on an air float conveyor system, if desired.

Figure 4:
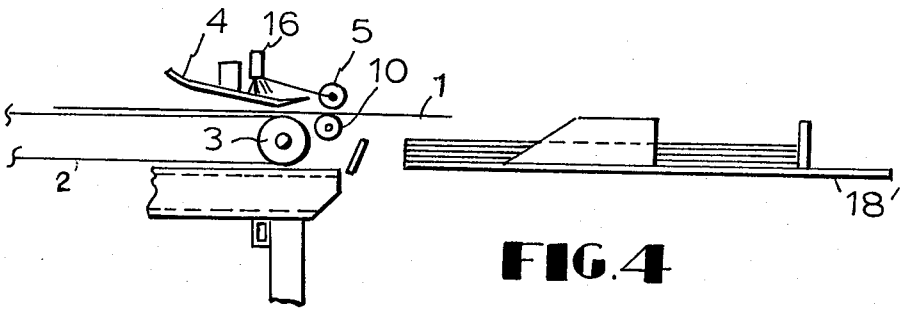

In FIG. 4, the first before-described condition of overlapping operation, as in FIGS. 1 and 2, or stacking operation as in FIG. 3, is shown. The sheet 1 is passing under raised snubber rolls 5, being confined from coming into contact with them by the guide shoes 4. The sheet is traveling at maximum speed at this point in time and both the slow-down rolls 10 and snubber rolls 5 are non-rotating. The monitoring photocell 16 has its light path interrupted by the sheet 1.

Figure 5:
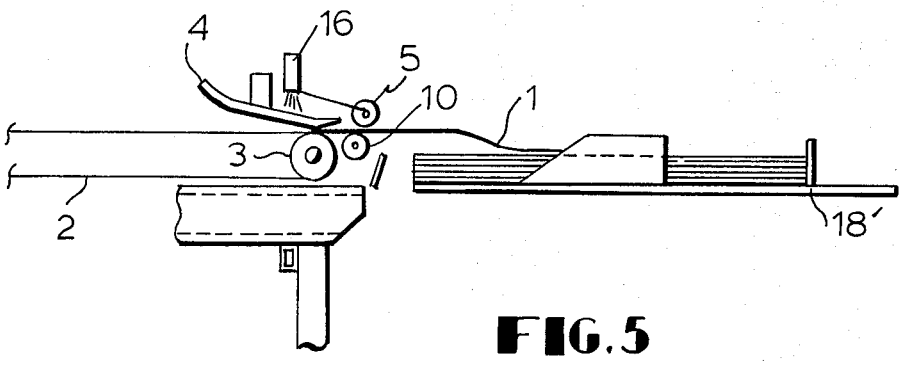

The sheet 1 has just passed beyond the photocell 16 in FIG. 5, and the resulting signal (such as may be evidenced by output relay contact closing) causes the slow-down roll 10 to start to rotate in the same direction as the path of travel of sheet 1, as before explained. The snubber rolls 5 are still in raised position and not rotating, and the sheet 1 is restrained from contact with them by the confining guide shoes 4. The sheet 1 is still traveling at maximum speeds at this time.

Figure 6:
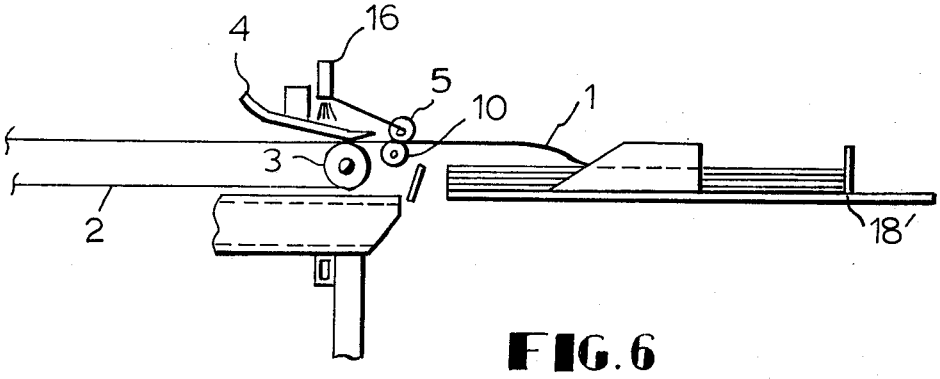
Figure 7:
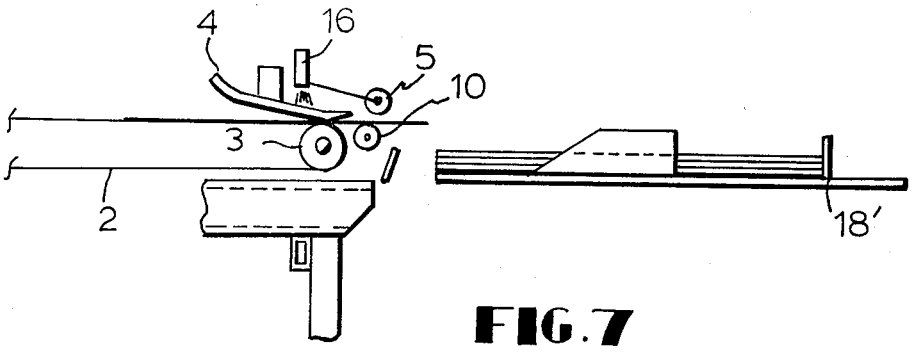

In the position shown in FIG. 6, the slow-down roll 10 has now attained its maximum speed, equal to the speed of the conveyor 2. The snubber rolls 5 have come into contact with sheet 1 forcing it against the slow-down roll 10, as previously described. The speed of the sheet is now reduced by the slow-down rail 10 and its decelerating drive, three-gear, four-bar linkage gear box unit 11 (FIG. 1), to the desired speed at which it is to make contact with the front stops 2' of FIG. 3 or at which it is to be deposited upon the slow-moving conveyor 18 of FIGS. 1 and 2. Immediately after slowing the sheet 1 to the desired controlled speed, as shown in FIG. 7, the slow-down roll 10 stops rotating, snubber rolls 5 raise (and, being non-driven, also stop rotating), and the leading edge portion of the next successive sheet 1 is allowed freely to pass under the slow-down mechanism at the full speed of the high-speed conveyor 2, being protected from coming into contact with the stationary snubber rolls 5 by the guide shoes 4.

By varying the diameter of the slow-down roll 10, the distance during which the slowing-down action takes place can be varied. For example, if it is assumed that in FIG. 1, the circumference of the slow-down roll 10 is approximately 6 inches, and that the number of degrees of rotation between the time the snubber rolls 5 come into contact with slow-down roll 10 to grab the sheet 1 and start to release from roll 10 (FIG. 8C) is 180° or half of a revolution, the distance the sheet 1 will travel during the slow-down action will be one-half the circumference; or, in this case, 3 inches. The shock of the slow-down can thus be reduced, or the distance traveled during the slow-down period can be increased by increasing the circumference of the slow-down roll. With a slow-down roll of 8 inches circumference, for example, it would take 4 inches to slow down the sheet.

It should further be pointed out that the quicker the slow-down action (that is, the smaller diameter of the slow-down roll), the less spacing is needed between successive sheets in the high-speed conveyor section 2. The longer the slow-down action, moreover, the less pressure is required between the slow-down roll and the snubber rolls. These relationships of diameters and pressures can therefore be varied, depending on the materials, sheet spacings and velocities of particular machine requirements.

Further modifications will also occur to those skilled in this art, and such are considered to fall within the spirit and scope of the invention as defined in the appended claims.

What is claimed is:

1. A method of slowing the delivery of sheets carried by a high-speed conveyor before deposit upon such an area as low-speed conveyors and stacking platforms, that comprises, feeding successive sheets at relatively high speed over a slow-down region preceding such an area; monitoring the approach of the rear portion of each successive high-speed sheet towards said region and thereupon grabbing such rear portion and decelerating the grabbed sheet to a predetermined slower speed; releasing the grabbed sheet to enable delivery of the same at said predetermined slower speed upon said area; and thereupon feeding the leading portion of the next successive sheet at said high speed over the said region, the grabbing and decelerating being effected by means that is moving at a speed substantially the same as said high speed when said rear portion is grabbed and that is thereupon gradually decreased in speed to decelerate the grabbed sheet to said slower speed.

2. A method as claimed in claim 1 and in which said grabbing and decelerating are effected by a normally stationary slow-down roll disposed at said region and brought to rotational speed corresponding substantially to that of the high speed feeding of the sheets in response to said monitoring, and thereupon forced into engagement with the said rear portion of the sheet to effect the deceleration of the same, after which the grabbed sheet is released from such engagement and the roll returns to its stationary condition.

3. A method as claimed in claim 2 and in which the forced engagement of the sheet is effected by applying a snubber roll against the sheet to be grabbed as it passes over said slow-down roll, and the decelerating is effected by gear-controlled speed reduction of said slow-down roll during the application of the snubber roll.

4. A method as claimed in claim 3 and in which the pressure of application of the said snubber roll is adjusted to vary the time of the slow-down action.

5. A method as claimed in claim 2 and in which the released sheet delivered upon said area is conveyed away at a speed, selected to determine the desired degree of overlap of successive sheets delivered upon said area.

6. Apparatus for slowing sheets carried by a high-speed conveyor having, in combination, high-speed conveyor means for feeding successive sheets at relatively high speed to a predetermined region; means for monitoring the approach of the rear portion of each successive sheet towards said region; slow-down means responsive to said monitoring for grabbing such rear portion, decelerating the grabbed sheet to a predetermined slower speed, and thereupon releasing the grabbed sheet to enable delivery of the same at said predetermined slower speed; and means for receiving the successive slower speed delivered sheets, said slow-down means comprising means that is moving at a speed substantially the same as said high speed when said rear portion is grabbed and that is thereupon gradually decreased in speed to decelerate the grabbed sheet to said slower speed.

7. Apparatus as claimed in claim 6 and in which the receiving means comprises relatively slow-speed conveyor means for receiving the slower speed sheets in predetermined overlapped relation.

8. Apparatus as claimed in claim 6 and in which the receiving means comprises platform means for receiving the slower speed sheets to stack the same.

9. Apparatus as claimed in claim 6 and in which said slow-down means comprises a normally stationary slow-down roll means and a normally separate snubber roll means, means operable upon the monitoring means sensing the approach of the rear portion of each successive sheet for setting the slow-down roll means into rotation until its speed approaches that of the high-speed conveyor means, means for thereupon forcing the snubber roll means into engagement against the slow-down roll means wth the sensed sheet interposed thus grabbing the sheet, means for thereupon decelerating the slow-down roll means to reduce the speed of the grabbed sheet to said predetermined slower speed, and means for thereafter releasing the snubber roll means from engagement with the slow-down roll means and rendering the same stationary again.

10. Apparatus as claimed in claim 9 and in which guide means is provided in the said predetermined region to maintain the next successive high-speed sheet out of contact with the released snubber roll means.

11. Apparatus as claimed in claim 9 and in which the means for rotating and decelerating the slow-down roll means comprises a multiple gear, multiple-bar linkage cooperative with a single revolution clutch, producing one revolution at a variable speed starting at zero speed, rising to double input speed and slowing back to zero speed in response to each monitoring of the arrival of the rear portion of each successive sheet at the monitoring means.

* * * * *